United States Patent [19]

Ostoich et al.

[11] Patent Number: 5,028,142

[45] Date of Patent: Jul. 2, 1991

[54] RECIPROCAL MIXER

[75] Inventor: Vladimir Ostoich, San Jose; Ian Gibbons, Menlo Park; Robert Hillman, San Diego; Michael Cobb, Sunnyvale, all of Calif.

[73] Assignee: Biotrack, Inc., Mountain View, Calif.

[21] Appl. No.: 334,304

[22] Filed: Apr. 6, 1989

[51] Int. Cl.[5] ..... B01F 13/08

[52] U.S. Cl. ..... 366/273; 356/427; 366/143

[58] Field of Search ..... 366/140, 142, 143, 273, 366/274, 127; 422/99, 100, 101, 102; 356/426, 427

[56] References Cited

U.S. PATENT DOCUMENTS

| | | | |
|---|---|---|---|
| 2,958,517 | 11/1960 | Harker | 366/273 |
| 3,356,346 | 12/1967 | Landsberger | 366/274 |
| 3,384,353 | 5/1968 | Worth | 366/274 |
| 3,981,594 | 9/1976 | Kenyon | 356/427 |
| 3,997,272 | 12/1976 | Kenyon | 356/427 |
| 4,465,377 | 8/1984 | Bruyne | 366/273 |
| 4,549,812 | 10/1985 | Bothorel | 356/427 |

*Primary Examiner*—Robert W. Jenkins
*Attorney, Agent, or Firm*—Richard L. Neeley

[57] ABSTRACT

A mixing system comprising (1) a mixing cartridge comprising a housing containing: (a) an internal chamber, (b) access means for entry of a liquid into the internal chamber, and (c) a magnetically movable detached mixing member contained in the chamber; and (2) a control device comprising a second housing containing: (a) a detection system adapted to measure a property of a liquid at a prespecified first location in the chamber of the mixing cartridge, (b) means for holding the cartridge so as to register the chamber with the detection system, and (c) means for magnetically imparting linear reciprocal motion to the mixing member, whereby the mixing member sweeps out a portion but less than all of the volume of the chamber, the motion generally occurring at a second location in the chamber different from the first location. The mixing cartridge itself is also a part of the present invention.

27 Claims, 2 Drawing Sheets

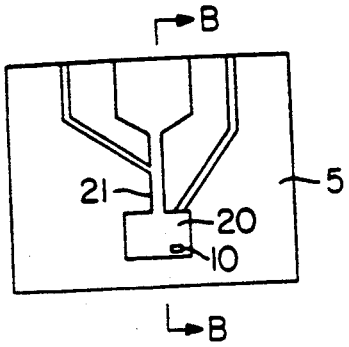
FIG. 7A
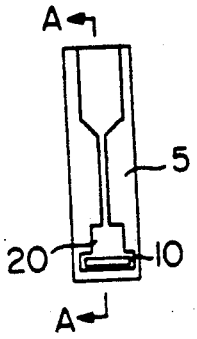
FIG. 7B
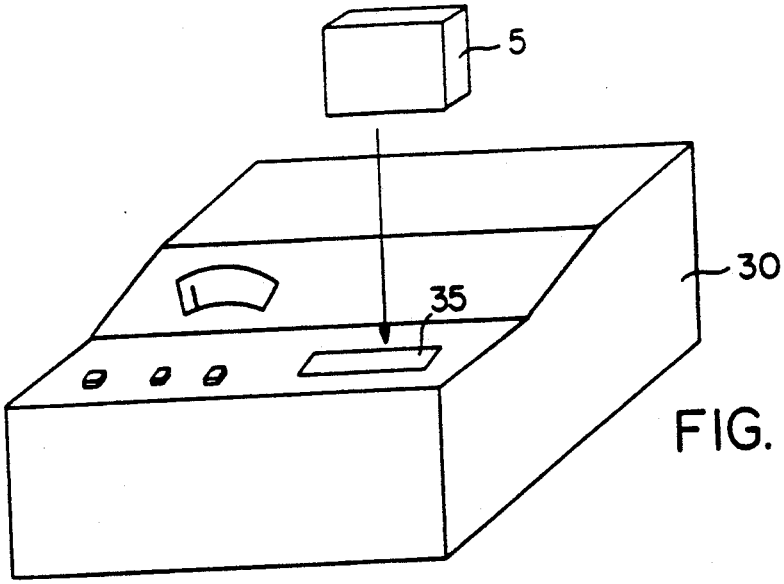
FIG. 8
FIG. 9A
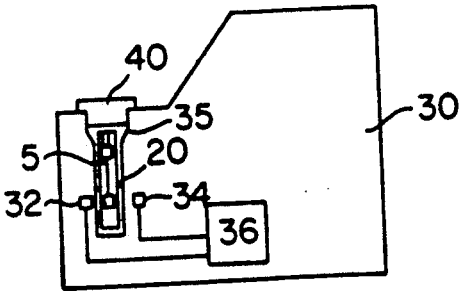
FIG. 9B
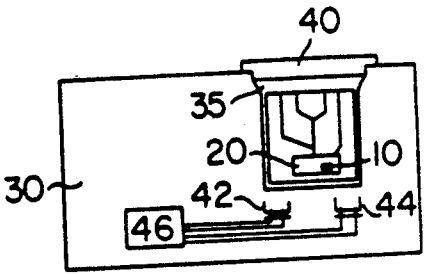

RECIPROCAL MIXER

BACKGROUND OF THE INVENTION

1. Technical Field

This invention relates to methods and apparatuses used for dissolving and mixing reagents in liquids, particularly mixing of small volumes in enclosed chambers.

2. Background

An increasing number of chemical and biochemical assays are being carried out in very small chambers. This is especially true for diagnostic assays where small samples are preferred. In many cases solvents and reagents are mixed and a reaction is carried out in a cuvette in which an optical measurement will be made at a later time. The cuvette is inserted into an apparatus such as a spectrophotometer including one or more optical paths in which sample or reference materials are inserted in order that the light absorption characteristics of the reaction products can be evaluated. The cuvette comprises a small rectangular or other-shaped container having opposed sides which are relatively transparent to the wavelengths of light being utilized during analysis.

Although the extent of mixing required depends on the nature of the sample being analyzed and the reagents present, some mixing must occur within the cuvette before reaction between the sample and reagents can take place. Motor-driven paddles can be used if the cuvette is open but not if the cuvette is closed. One common arrangement for mixing involves the use of so-called magnetic stirrers. In this well known arrangement, a magnetically responsive agitator is positioned in a cuvette or other container and is caused to rotate in the presence of an externally applied rotating magnetic field. Typically, the rotating magnetic field is provided by a bar magnet which is mounted beneath the container and rotates about a vertical axis so that the magnetic poles of the bar magnet rotate in a horizontal plane. In this arrangement the magnetic stirring body is itself rotatable in a horizontal plane around a vertical axis and includes permanent or induced magnetic poles spaced apart from its vertical axis.

Magnetic stirring as described above is typically carried out in round containers or containers characterized by a substantially square internal cross section. U.S. Pat. No. 3,997,272 indicates that such magnetic stirrers have been found to be relatively unacceptable in those instances where the internal cross section of the cell departs significantly from a square or circle. Cylindrical stirrers rotating about a horizontal axis in the presence of a horizontally or vertically rotating magnetic field are said to be more efficacious in rectangular cells. Numerous other publications describe magnetically controlled mixers of various types and motions, most of which sweep out relatively large volumes of the chamber in which they are contained.

In most cases, the previously known mixing bodies are not designed for use in a substantially closed container in which any liquid present is constrained on all sides by the walls of the chamber but are rather designed for vessels open to the external environment on one side (generally the top). Furthermore, little attention has been given to problems that arise when measurements are made in a chamber that initially contains a dried reagent that might be dislodged by accidental contact with the mixing body such as during transport or handling. Problems are compounded in situations in which the dried reagent is difficult to dissolve, must be uniformly dissolved, or must be uniformly suspended (e.g., for particulate reagents, such as latex agglutination reagents). Accordingly, there remains a need for improved mixing systems for small enclosed liquid samples.

SUMMARY OF THE INVENTION

The present invention provides a mixing and measuring system, comprising: (1) a mixing cartridge comprising a housing containing: (a) an internal chamber, (b) access means for entry of a liquid into said internal chamber, and (c) a magnetically movable detached mixing member contained in said chamber; and (2) a control device comprising a second housing containing: (a) a detection system adapted to measure a property of a liquid at a prespecified first location in said chamber of said mixing cartridge, (b) means for holding said cartridge so as to register said chamber with said detection system, and (c) means for magnetically imparting linear reciprocal motion to said mixing member, whereby said mixing member sweeps out a portion but less than all of the volume of said chamber. In some embodiments two opposed walls of the chamber provide an optical path through the first volume while the mixing member is a flat plate that slides back and forth across a lower surface of the chamber under the influence of a variable magnetic field.

BRIEF DESCRIPTION OF THE FIGURES

This invention will be better understood by reference to the following detailed description of specific embodiments when considered in combination with the drawings that form part of this specification, wherein:

FIG. 7A is a vertical cross-sectional front view of a mixing cartridge of the invention.

FIG. 7B is a vertical cross-sectional side view of a mixing cartridge of the invention.

FIG. 8 is a perspective view of an insertable mixing cartridge and a control device into which the mixing cartridge fits.

FIG. 9A is a vertical cross-sectional front view of a mixing cartridge inserted into a control device.

FIG. 9B is a vertical cross-sectional side view of a mixing cartridge inserted into a control device.

DETAILED DESCRIPTION OF SPECIFIC EMBODIMENTS

The present invention provides a mixing system that has been demonstrated to be more practical than rotating stirring bars when mixing liquid samples and dissolving dry reagents in small volumes while sweeping out only a fraction of the total volume of a chamber, thereby allowing most of the chamber to be used in carrying out a measurement of the reaction that has occurred or is occurring in the chamber without interference by the mixing member. In preferred embodiments of the invention, the mixing member is a magnetically inducible flat plate constrained by gravity or otherwise to reside on a lower flat surface of the chamber while being confined by the geometry of the chamber to substantial movement in a horizontal plane in one direction only. In some embodiments of the invention, the mixing member is confined in a pair of parallel grooves in opposite faces of the chamber so that vertical motion (such as under the influence of external forces during shipping) is also prevented. In some embodiments rotational motion of the mixing member around a vertical axis is prevented by providing a mixing member in which at least one dimension of the member in a horizontal plane is longer than the width of the chamber. For example, a rectangular mixing member will have a width slightly less than but nearly equal to the width of the chamber but will be provided in sufficient length so that the diagonal distance between opposite corners of the plate is longer than the width of the mixing member. The invention is particularly useful for mixing liquids and reagents in non-square, regular parallelapiped chambers (which can be provided with grooves or ridges as described herein for limiting movement of the mixing member).

Figure 1:
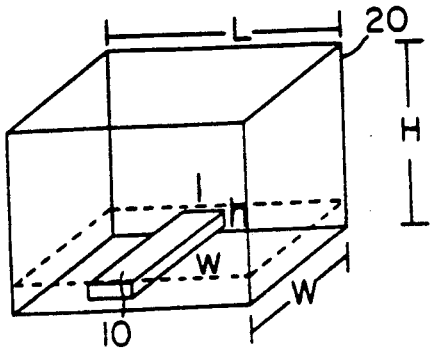
FIG. 1 is a perspective view of a first embodiment of the invention.

A consistent reference scheme defining axes along which measurements are to be made is set forth in FIG. 1 and the following description. FIG. 1 shows a regular parallelapiped chamber of height H, width W, and length L. Height refers to the vertical axis in a gravitational field, while width refers to the shorter horizontal axis and length to the longer horizontal axis. Corresponding small letters are used to indicate the dimensions of the mixing member; however, since the designations l and w indicate the measurements in the same direction as the length and width of the chamber (L and W), w can exceed l in length.

In this specification, mixing chambers are sometimes referred to as having first and second volumes contiguous to each other at an interface. These are in fact adjoining spaces in a single chamber. The second volume is all the space in the chamber that is or can be occupied by the mixing member as it moves in the chamber. The first volume is the remaining space in the chamber and typically but not necessarily contains the location were measurements are made. It is also possible to carry out measurements in the second volume that is swept out by the mixing member. In such cases, the mixing member is "locked" into a fixed position during measurement. For example, a magnet located at one end of the mixing chamber can be used to draw the mixing member to that end while a measurement is made at the other end of the mixing chamber in the space recently vacated by the mixing member. If the geometry of the chamber and mixing member are so designed, it is possible to move the mixing member to one end of the chamber and then turn off the magnet that causes the motion. For example, this embodiment can be carried out if the mixing member is a flat plate that resides under gravitational force on the bottom flat surface of a mixing chamber. However, embodiments in which the mixing member is positively restrained from motion are preferred.

In order to maximize the volume of the chamber that can be used for measurement without being interfered with by the mixing member, H is therefore usually significantly larger than h, with the ratio of H/h generally being at least 2, preferably at least 3 and more preferably at least 5, preferably no more than 20, more preferably no more than 10. L is significantly larger than l in order to provide for substantial motion of the mixing member in the direction of the L axis. Typically, the ratio L/l is at least 1.1, preferably at least 1.5 but is preferably less than 5, more preferably less than 3. W is typically only slightly longer than w to allow freedom of movement without allowing a twisting motion which might bind the mixing member in the chamber. Other preferred variations include providing: H less than or equal to 3L or 3W or hlw greater than or equal to 0.01 HLW. If motion of the mixing member along the W axis is preferred for a particular embodiment, the preferred relative values for L/l and W/w are reversed. Elongated chambers (L>>W) that are not effectively mixed by means of rotating stir bars can be used advantageously with a mixing member as described herein. This is particularly advantageous when mixing of extremely small volumes (e.g., 50 μl) is required together with a long optical path length (e.g., 1 cm). Problems associated with poor reproducibility of starting of rotating mixers are also avoided.

The preceeding paragraph assumes that a primarily horizontal mixing member undergoing horizontal motion is present in the chamber. If a primarly vertical mixing member is used with motion in a vertical or horizontal plane, the direction of motion is considered to be the L axis with the L and W axes defining the plane of the interface between the sweptout and undisturbed volumes and the H axis being at right angles to the LW plane.

The housing that forms the chamber can be prepared from any inert material suitable for use as container walls and will vary depending on the reagent, liquid, and measurement to be used in the chamber. Examples of measurements include optical measurements (such as absorbance spectrophotometry, turbidimetry, fluorometry, measurement of agglutination by light scattering, and the like), electrochemical measurements resulting from the insertion of electrodes into the chamber or the use of electrodes built into chamber walls, infrared spectrophotometry, and visual inspection. Any other measurement technique that can be better effected by providing a space free of disturbance from the mixing member will be aided by use of a mixing unit of the type described herein. The apparatus is particularly useful in devices with enclosed chambers that provide an optical path through opposed walls of the chamber at a location different from the volume swept out by the mixing member. The mixing system is particularly useful for providing efficient mixing in chambers having a total volume of no more than about 1000 μl, preferably no more than about 300 μl and more preferably no more than about 200 μl. However, there is no absolute restriction on the upper limit of the chamber volume.

Figure 2:
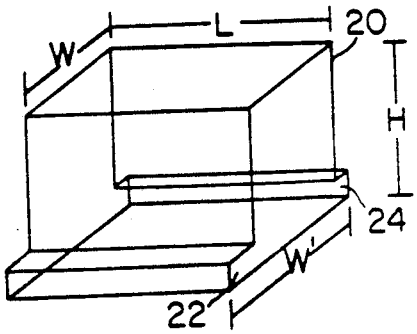
FIG. 2 is a perspective view of a second embodiment of the invention.
Figure 3:
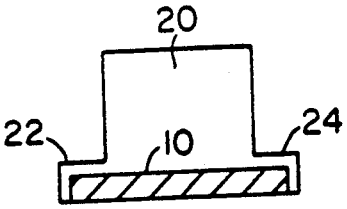
FIG. 3 is a vertical cross-sectional view of the embodiment shown in FIG. 2.
Figure 4:
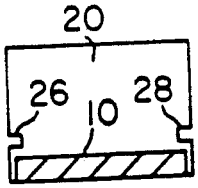
FIG. 4 is a vertical cross-sectional view of a third embodiment of this invention.

In a preferred embodiment exemplified in FIGS. 2–4, grooves or ridges are provided to prevent mixing member 10 from being dislodged from its assigned volume of the chamber during shipping or handling of a device containing a chamber of the invention. Restraint can be provided by a set of parallel grooves or ridges in opposite faces LH of the chamber. A single groove or ridge can be used to confine the mixing member if sufficiently sized to prevent twisting motions of the mixing member. FIG. 2 shows two grooves 22 and 24 in opposite sides of chamber 20 that can be used to trap mixing member 10 (not shown). These grooves provide a width W′ at this location somewhat wider than width W throughout the upper portion of chamber 20. FIG. 3 shows a vertical cross-sectional view along an arbitrary WH plane showing mixing member 10 being trapped on a bottom surface of chamber 20 by parallel grooves 22 and 24. FIG. 4 shows a similar embodiment in which mixing member 10 is trapped on a bottom surface of chamber 20 by ridges 26 and 28. When ridges, grooves, or the like are provided to restrain the motion of the mixing member to motion in a single plane, the location of the mixing member can be varied widely. For example, the mixing member can move vertically along a side or end wall or horizontally along a side or end wall or even an upper surface of the chamber. Furthermore, movement can be restricted by opposed grooves or pairs of ridges to a plane bisecting the chamber and providing free space for measurements on both sides of the mixing member.

Figure 5:
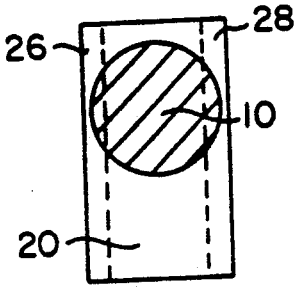
FIG. 5 is a horizontal cross-sectional view of the embodiment shown in FIG. 4.

As an alternative to providing rectangular (or similar) mixing members with diagonals greater in length than W (to avoid loss of the mixing member from the groove), a circular mixing member as shown in FIG. 5 can be provided. The circular mixing member is again constrained to reside on the bottom of chamber 20 by ridges 26 and 28, similar to ridges 26 and 28 of FIG. 4. Circular mixing members are useful for preventing binding and/or sticking of the member in the groove.

The linear motion imparted to the mixing member in the chamber can be provided by a number of means and techniques. For example, the housing in which the chamber is located can be tilted from side to side to allow the mixing member to slide from one end of the chamber to the other under influence of gravity. This can be accomplished either manually or by providing an automated apparatus in which the housing containing the chamber resides and which imparts the tilting motion to the housing. However, such gravitational motion is not preferred, as it complicates the mechanical constraints of the apparatus that will carry out the measurement in the chamber.

Magnetically induced motion of the mixing member is preferred. Such motion can readily be imparted to a magnetic or magnetically inducible mixing member in a non-magnetic housing. The mixing member can comprise either a permanent magnet or a magnetically inducible metal, such as an iron or nickle alloy. Stainless steel is a preferred metal. The mixing member can be encased in a molded sheath of chemically inert material or otherwise covered to reduce friction and/or interactions with reagents or solutions. Examples of materials for coverings include polytetrachloroethylene and similar fluorinated hydrocarbons, glass, and plastic (such as ABS or polystyrene). A molded plastic sheath of fixed volume is preferred for use in embodiments in which the remaining volume of the chamber must be carefully controlled.

Figure 6:
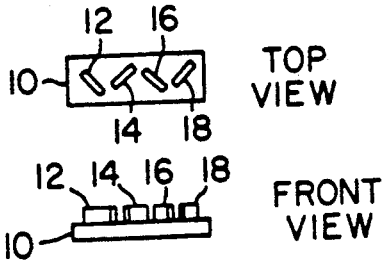
FIG. 6 is two views, top and front, of a second embodiment of mixing member 10 shown in FIG. 1.

Although the mixing member can be substantially planar as described above, it is also possible to have grooves and ridges of various shapes and configurations to create a turbulent flow pattern when the mixing member is being moved, thereby increasing mixing actions. Exemplary ridges in the form of mixing veins 12, 14, 16, and 18 on mixing member 10 are shown in FIG. 6. Any other shape can be provided for the mixing member as long as it provides for reciprocal motion in a plane while being restricted to a portion of the total volume of the internal chamber.

The existence of many known techniques for mixing using magnetic propulsion systems will provide guidance to those who wish to practice the present invention. Local magnetic field strengths, distances between the mixing member and the location at which the magnetic fields are being generated, magnetic shielding effects, and the like will be already understood. Accordingly, the exact method and apparatus used to generate a magnetic field or fields that will move the mixing member back and forth in the chamber can vary widely while remaining within the scope of the present invention. For example, a single coil can be used to produce two magnetic fields of opposite polarity near one end of the chamber by alternating the direction of current through the coil. If the magnetic member is a permanent magnet oriented with one pole facing the coil, the magnet will be alternatively attracted to and repulsed from the coil, thereby moving the magnet (mixing member) back and forth in the chamber. Alternatively, a separate coil can be present at each end of the chamber to alternately attract or repel a permanent magnet or to alternately attract a magnetically inducible metal. Still additionally, a movable permanent magnet (e.g., motor driven) can be used to move either a magnetized or magnetically inducible mixing member.

Preferred embodiments of the invention use a minimum number of movable parts in order to increase reliability and therefore rely on the generation of magnetic fields by passing current through one or more coils to cause movement of the mixing member.

Furthermore, preferred embodiments use a magnetically inducible mixing member, as opposed to a permanent magnet, in order to minimize expense when the device comprising the chamber and mixing member is disposable, as will often be the case.

The rate of reciprocal motion can vary widely. If a "cycle" is considered to be motion of the mixing member from one position to a second position and then return to the first position, typical cycle rates are from about 0.3 to about 100 hertz (cycles per second). Preferred are cycle rates of about 1 to about 20 hz, more preferably 2–10 hz.

An examplary mixing cartridge is shown in FIG. 7 with FIG. 7A being a cross-sectional side view and FIG. 7B being a cross-sectional end view. Housing 5 contains a number of internal chambers and channels. An entry port 21 into mixing chamber 20 and vent 22 are shown in FIG. 8 along with mixing member 10. Additional detail in the chamber housing is omitted, since such detail is not relevant to the present invention. The chamber unit can form part of apparatuses designed for analytical techniques, such as those described in commonly assigned U.S. application Ser. No. 090,026, filed Aug. 27, 1987.

An exemplary control device (monitor) into which a mixing cartridge of the invention can be inserted is shown in perspective in FIG. 8. Slot 35 in base 30 receives and aligns the housing 5 that contains the chamber unit (not shown in this Figure) so as to register any optical equipment or other detecting means with the portion of the chamber in which a measurement will be made. FIG. 9 shows cross-sectional view of a chamber unit that has been inserted into a measuring unit. FIG. 9 shows Chamber housing 5 being held in slot 35 by base 30 and top cover 40 in order to provide proper register of chamber 20 with measurement and recording parts of the measuring unit. Light source 32 and detector 34 are connected electronically to control means 36. Side view 9B shows electromagnets 42 and 44 spaced apart but adjacent to the ends of chamber 20. Control unit 46 alternatively supplies power to electromagnet 42, which draws mixing member 10 to the left end of chamber 20 as shown, or electromagnet 44, which draws mixing member 10 to the right end of chamber 20 as shown.

In addition to the advantages previously discussed, devices of the present invention are particularly useful when prepared in the form of disposable mixing cartridges containing dry reagents. Dry reagents are much more stable under normal circumstances than the same reagent formulation prepared in liquid. Accordingly, disposable cartridges containing dry reagents are particularly useful in situations where the reagent cartridge will be stored for later use. However, dry reagents are also difficult to reconstitute evenly. By providing the reagent dried on the surface of the mixing chamber of the present invention, an analytical device suitable both for long term storage and for easy reconstitution of the reagent contained in the device is provided.

The invention now being generally described, the same will be better understood by reference to the following examples which are provided for purposes of illustration only and are not intended to be limiting of the invention unless so specified.

EXAMPLES

Model Chamber Units

Model reaction and mixing chambers were constructed from polystyrene, semi-micro UV cuvettes (Kew Scientific). Cuvettes were cut to a height of 0.5 cm or 0.8 cm and two holes (0.05 cm in diameter) were drilled in the bottom to serve as a liquid port and a vent. The cut cuvette was inverted, and a piece of polished steel ($0.75\times0.34\times0.08$ cm) was inserted as a mixing member. Finally, pieces of polished acrylic ($1.21\times0.57\times0.05$ cm) were glued over the open ends to produce the finished model cartridge containing the internal chamber formed by the cuvette walls and polished acrylic end pieces. The inner dimensions of the chambers were $1.00\times0.39\times0.44$ cm (140 $\mu$L; small chamber) and $1.00\times0.39\times0.76$ cm (270 $\mu$L; large chamber). The final volume of the chambers as stated are corrected for the volume of the mixing member.

Model Spectrophotometer

To read the assay being carried in the modeled mixing and reaction chambers, a fixture was made to position the chambers in a Hewlett Packard 8451. A spectrophotometer so that the light beam passed down the long dimension of the reaction chamber. The fixture had a mask with a hole of 0.17 cm (adjustable) diameter mounted such that the light passed only through the liquid-filled part of the reaction chamber. The cartridges were registered in the fixture with either a spring-loaded plate or a locator pin. Temperature control was achieved with two transistors (3 amp; National 2N4921) located in contract with the cartridge side walls and controlled electronically to provide a constant temperature in the chamber. A magnetic driving mechanism, designed to power a reciprocating motion of the mixing member, was located under the carriage and is described later in detail. The control for this device provided means to adjust the frequency of the motion in the range 1–10 cycles/second (Hz). Unless otherwise noted, a frequency of 3 Hz was used.

Magnetic Driving Mechanism

The mixing-member driver was made up of a commercially available integrated-circuit oscillator (Signetics NE555) with a variable frequency range of approximately 3 Hz to 120 Hz. A flip-flop circuit (NSC 74107) was used to provide a symmetrical duty cycle. Transistor switches were provided to alternatively switch current through the individual electromagnets which were physically located in close proximity to each other. The individual magnets were made on iron cores prepared in standard C shapes with a length of 0.200 inch, a width of 0.180 inch, an end-heigth of 0.180 inch, and a height at the winding of 0.60 inch. Approximately 200 turns of no. 36 copper magnet wire with a resistance of about 4.5 ohms was used on each magnet. The mixing bar driver was placed directly co-axially under the model chamber so that the gap between the two magnets was centered under the chamber.

Comparative Tests

A series of comparative tests were performed using an agglutination reaction to determine the efficiency of the mixing system of the invention. The agglutination reaction was between a reagent composed of (1) suspended small latex particles (about 80 nm diameter) coated with an antibody and (2) an agglutinator reagent made by covalently attaching several copies of the epitope recognized by the antibody to a soluble polymer. The reaction caused increased turbidity, which was monitored by measuring changes in transmitted light at 540 nm. In a first series of examples, reagents were added sequentially to the model reaction and mixing chambers using liquid reagents with or without mixing. When the reagents were added together without mixing, the reaction was much slower than the reaction that occurred when mixing was carried out by the system of the invention, indicating that mixing in the chamber does not take place by convection alone but requires active mixing.

In a second series of examples, the agglutinator reagent was dried onto the model reaction chamber walls, and the mixer was then used to dissolve the agglutinator after liquid antibody/latex reagent had been added. Without the mixer, almost no reaction was seen. With the mixer, the reaction occurred at a rate comparable to that observed for liquid agglutinator (discussed above). This example indicated that the mixer is capable of dissolving and mixing a dried reagent within the time frame (less than 30 seconds) necessary for the assay, in addition to mixing liquid reagents added to the chamber.

In other examples, the agglutination reaction was used to assay analytes (monomeric epitopes) that reacted with the antibody in a competitive agglutination inhibition immunoassay. Results were compared with those obtained in a test-tube assay run external to the reaction in mixing chamber under comparable conditions of temperature or with results obtained in the model chambers after mixing sample and liquid reagents outside the cartridge. Quantities of reagents were chosen such that their final concentrations were identical in experimental and control (external mixing) situations. In both experiments, the response in the chambers closely replicated that in the control experiments where there was complete mixing outside the mixing chambers of the invention.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A mixing and measuring system, comprising:

(1) a mixing cartridge comprising a housing containing:

(a) an internal chamber, (b) access means for entry of a liquid into said internal chamber, and (c) a magnetically movable detached mixing member contained in said chamber; and (2) a control device comprising a second housing containing:

(a) a detection system adapted to measure a property of a liquid at a prespecified location in said chamber of said mixing cartridge, (b) registration means for holding said cartridge so as to register said chamber with said detection system, and (c) means for magnetically imparting linear reciprocal motion to said mixing member, whereby said mixing member sweeps out a portion but less than all of the volume of said chamber.

2. The system of claim 1, wherein said chamber has a substantially flat bottom surface.

3. The system of claim 2, wherein said mixing member is supported by said bottom surface.

4. The system of claim 3, wherein said mixing member has substantial freedom of movement on said bottom surface only in the direction of said linear motion.

5. The system of claim 3, wherein two opposed walls of said chamber provide an optical path through said first volume.

6. The system of claim 1, further comprising means for retaining said mixing member in said sweptout volume of said chamber.

7. The system of claim 6, wherein said retaining means comprises parallel retaining grooves in opposite walls of said chamber.

8. The system of claim 1, wherein motion of said mixing member divides said volume into an unswept first volume and a swept out second volume and said location in said chamber is in said first volume.

9. The system of claim 8, wherein said mixing member comprises a plate having a height substantially equal to the height of said second volume, a width substantially equal to but less than the width of said chamber in said second volume, and a length substantially less than the length of said chamber in said second volume.

10. The system of claim 8, wherein said mixing member further comprises mixing vanes on said plate.

11. The system of claim 8, wherein the ratio of plate height to chamber height is from 1:1.5 to 1:20.

12. The system of claim 1, wherein said means for imparting motion comprises means for generating two magnetic fields of opposite polarity.

13. The system of claim 1, wherein said means for imparting motion comprises a movable permanent magnet.

14. The system of claim 1, wherein said means for imparting motion comprises means for generating magnetic fields at at least two different locations adjacent to said housing.

15. The system of claim 1, wherein said chamber has a total volume of no more than about 3 mL.

16. The system of claim 1, wherein said mixing member comprises a magnetically inducible metal and is unmagnetized.

17. The system of claim 16, wherein said metal is encased in a molded plastic sheath of fixed volume.

18. The system of claim 1, wherein said mixing member sweeps out no more than 20% of the total internal volume of said chamber.

19. A mixing cuvette comprising:

a housing containing an internal chamber;

a magnetically movable mixing member in said chamber; and restraining means in said chamber substantially restricting motion of said mixing member to linear motion in one dimension in said chamber, wherein motion of said mixing member is restricted to a volume v in said chamber without entering a volume V in said chamber;

wherein said housing comprises optically transparent windows forming at least a portion of opposed sides of said chamber and providing an optical path through volume V.

20. The cuvette of claim 19, wherein said chamber has a planar bottom surface and said mixing member contacts said bottom surfaces.

21. The cuvette of claim 19, wherein said restraining means comprises parallel grooves in opposite walls of said chamber.

22. The cuvette of claim 19, wherein said restraining means comprises parallel ridges in opposite walls of said chamber.

23. The cuvette of claim 19, wherein said chamber comprises essentially rectangular upper, lower, and side surfaces and has a principal height H, a principal width W, and a principal length L, wherein $L > W$.

24. The cuvette of claim 19, wherein said mixing member comprises a substantially rectangular block.

25. The cuvette of claim 24, wherein said mixing member further comprises projections from said block.

26. The cuvette of claim 19, wherein said internal chamber has openings to an external environment comprising no more than 5% of the internal surface area of said chamber.

27. A mixing cuvette, comprising:

a housing containing an internal chamber of height H, width W, and length L; a magnetically movable mixing member of height h, width w, and length l in said chamber, wherein h/H is from 0.01 to 0.5, w/W is from 0.9 to 0.99, and l/L is from 0.1 to 0.8; and retaining means in said chamber substantially restricting linear motion of said mixing member to dimension L, wherein said mixing member sweeps out a volume v in said chamber without entering a volume V in said chamber; wherein said housing comprises optically transparent windows forming at least a portion of opposed sides of said chamber and providing an optical path through volume V.

* * * * *